US005605575A

United States Patent [19]

Anderson

[11] Patent Number: 5,605,575

[45] Date of Patent: Feb. 25, 1997

[54] INTERCHANGEABLE ADHESIVE-APPLYING APPARATUS

[76] Inventor: Clarence L. Anderson, 59 Rte. 24, Chester, N.J. 07930

[21] Appl. No.: 383,564

[22] Filed: Feb. 3, 1995

[51] Int. Cl.[6] ..... B05C 1/00

[52] U.S. Cl. ..... 118/679; 118/712; 118/101; 118/110; 118/202; 118/244; 118/259; 412/11; 412/13; 412/14; 412/37

[58] Field of Search ..... 118/667, 679, 118/712, 202, 223, 244, 255, 259, 428, 429; 156/356, 359, 368, 500, 578, 908; 427/8, 207.1, 208.2, 411, 428; 412/8, 11, 13, 14, 37

[56] References Cited

U.S. PATENT DOCUMENTS

| | | | |
|---|---|---|---|
| 3,371,330 | 2/1968 | Howard et al. | 11/1 |
| 3,560,311 | 2/1971 | Blair . | |
| 3,788,270 | 1/1974 | Blair | 118/5 |
| 3,863,596 | 2/1975 | Anderson | 118/244 |
| 4,019,457 | 4/1977 | Wetzler et al. | 118/35 |
| 4,310,576 | 1/1982 | Hesselmann et al. | 427/428 |
| 4,416,722 | 11/1983 | Bergman et al. | 156/578 |
| 4,484,850 | 11/1984 | Shimizu | 412/11 |
| 4,904,138 | 2/1990 | Champeaux et al. | 412/8 |
| 4,925,354 | 5/1990 | Cote | 118/679 |
| 4,925,355 | 5/1990 | Faber et al. | 412/37 |
| 5,250,318 | 10/1993 | Tooker | 427/8 |
| 5,252,018 | 10/1993 | Kitahara et al. | 412/11 |
| 5,443,639 | 8/1995 | Hawkes | 118/712 |

FOREIGN PATENT DOCUMENTS

| | | | |
|---|---|---|---|
| 0271295 | 10/1989 | Japan | 412/37 |

*Primary Examiner*—Laura Edwards

[57] ABSTRACT

A method and an operator interchangeable apparatus with fast warm up time for coating flowable and pasty materials onto a workpiece, especially for the application of glue and other adhesive substances to the back of signatures in bookbinding and the like, uses a first internally heated rotating roller for applying the material which is partly immersed in a bath thereof and a second internally heated roller to smooth and doctor the adhesive on clamped stacks of pages that have passed over the first roller. Production rates suitable of in-line use with reproduction equipment are achieved with no buildup on the edges. The relative velocity of the surface of the adhesive on the first roller is maintained at the same velocity as the clamped stack of pages. A mechanical adjustment device and method that provides for ease of interchangeability. A control device for proportioning the electrical power to the heating elements for the two rollers. Wattage of these heating elements is matched to each roller's heating requirements.

1 Claim, 7 Drawing Sheets

INTERCHANGEABLE ADHESIVE-APPLYING APPARATUS

CROSS REFERENCES TO RELATED APPLICATIONS

The invention of this application is an improvement on the invention of U.S. Pat. No. 3,863,596, granted Feb. 4, 1975.

BACKGROUND—FIELD OF INVENTION

My present invention relates to a method of and an aparatus for applying flowable liquid or pasty substances to a workpiece and more particularly, to a method of and an apparutus for applying hot-melt adhesives, glue, or other adhesive substances to the edges of a stack of sheets, e.g. signatures, adapted to form a pad, book or folio alone or in conjunction with a binding.

BACKGROUND—DESCRIPTION OF PRIOR ART

In the application of glue and like viscous adhesives to the edge of a stack of sheets or leaves or signatures in pad, book or folio binding, it is common practice to use a roller-type adhesive applicator in which the roller is rotated in a vessel constituting a heated reservoir for the adhesive and has its upper portion lying out of the bath and disposed to contact the underside of the stack which can be passed over the roller, as a workpiece, with sheets or leaves in an upright position. The adhesive or glue is thus picked up by the periphery of the roller from the bath and transferred to the edge of the stack as the latter is moved across the roller in the direction of the aligned edges of the stack of sheets as the roller is rotated. The direction of motion of the pages is unidirectional and parallel to the sheet edges with respect to the point of contact to the adhesive on the roller.

In general, one or more doctor blades may co-operate with the roller to control the thickness of the adhesive layer on the latter before it contacts the stack.

The stack, generally gripped in a clamp device and guided by rails or the like along a linear or curved path, crossed the roller at the top thereof. The roller is rotated in the direction of travel of the stack in some devices and in the opposite direction in other devices. With either approach there will be a build up a glob of the adhesive on either or both the leading or trailing edges because of the difference in relative velocity of the stack of pages and the adhesive on the roller.

To avoid this difficulty, the adhesive applying roller and the adhesive reservoir are lowered to provide means for dropping the top of the roller by a distance approximately equal to the thickness of the adhesive layer on the roller at the moment the leading edge would otherwise contact the roller, thereafter raising the system to bring about the contact and application of the adhesive. This system was sucessful in preventing the formation of a glob of adhesive at the leading edge of the stack but involved the use of complex kinematics, moveable adhesive-applying assemblies, as well as careful adjustment of the positions and movements of the latter. The system frequently went out of adjustment and was relatively expensive and often unreliable, especially where the mass which had to be moved was realitively large.

Hesselmann et al. U.S. Pat. No. 4,310,576 relates to a method in which a reversible drive for the roller is provided and rotating the roller in the direction of the movement of the stack until the stack reaches the contact point whereby a layer of adhesive is picked up by the roller from the bath or reservoir, thereafter rotating in the opposite direction while continuing the travel of the stack past the roller. This mode of operation, in conjunction with the provision of a dosing or metering compartment within the vessel and bath, preferably at the side of the roller downstream in the direction of the movement of the stack from the point at which the stack contacts the roller, has been found to eliminate the formation of globs without requiring any displacement of the contact point of the roller, provided that the metering compartment defines the periphery of the roller, two gap-like passages, the width of the upper passage being greater than the width of the lower passage or gap.

However, this system tends to be mechanically complex and expensive.

Another characteristic of present devices include melting of the adhesive in the reservior by external means taking 15 to 45 minutes to arrive at a usable viscosity.

Most present equipment does not allow for easy interchangeability of the adhesive applicator. The adhesive is changed by first heating the adhesive charge to operating temperature and draining the adhesive and then recharging and melting the new adhesive which due to the viscosity and warm up times required may take up to two hours.

Padding and bookbinding require different adhesives and in operations such as quick print shops, it is not uncommon that customers ask for fast turnaround. Also binding of books in-line on office copiers has similar requirements in addition to fast warm up time.

OBJECTS AND ADVANTAGES

It is the principal object of the present invention to provide a method of applying an adhesive or like viscous liquid or pasty substance to a stack of sheets or signatures, or some other workpiece, whereby the disadvantages of earlier systems are obviated.

Another object of the invention is to provide an improved apparatus for the application of adhesive to signature stacks which will avoid the formation of globs on the ends of the pages.

Another object of the invention is to provide for faster warm up time with the use of less power.

Another object of the invention is to provide for electrical and mechanical interchangeablity of the glue pot by an operator without using tools in a short period of time.

Another object of the invention is to provide a means for the ease of use of different adhesives for different applications, i.e. padding vs bookbinding.

Another object of the invention is to provide for the ease and stability of adjustment to overcome earlier constant adjustment problems mentioned in earlier patents associated with the complex mechanisms.

Another object of the invention is to provide for the feeding of the pages perpendicular to the edges of the stack.

Another object of the invention is to provide for faster application of the adhesive to achieve higher rates of production.

Another object of the invention is to provide the proper adhesive viscosity within 5 minutes of warm up time for a shorter warm up delay.

Another object of the invention is to provide for a means to prevent excessive buildup on the leading and trailing edges in the direction of travel, which are the side edges of the stack of pages i.e. the first and last pages.

Another object of the invention is to provide a device that can be used in-line on reproduction equipment, i.e. office copiers, computer printers, offset presses, and other equipment, to bind the collated or stacked pages.

Another object of the invention is to provide a means to produce the proper thickness of adhesive on the clamped stack of pages.

Another object of the invention is to provide for a smooth surface on the adhesive coating on the clamped stack of pages.

Another object of the invention is to provide for means of control of the adhesive temperature.

Another object of the invention is to provide for a proportioning interlocked control of the heating elements to limit the useage of power.

Another object of the invention is to provide for matching of the wattage of the heating elements to match the roller heating requirements to prevent overheating the adhesive.

Still further objects and advantages will become apparent from a consideration of the ensuing description and accompanying drawings.

SUMMARY OF THE INVENTION

These objects and others which will become apparent are attained, in accordance with the present invention, by providing two internally heated rollers rotating in the same direction with their surfaces traveling at the same velocity as that of the clamped stacked sheets contained in a vessel with a reservoir of adhesive that is mounted between two plates which are attached to a base plate containing three adjusting screws with locking nuts. Further an external controller using a thermocouple sensor is used to first set the desired melting temperature of the adhesive and then to control the rate of heat rise in the applicator roller, to turn the parent equipment on when the proper adhesive viscosity is achieved, to turn the heater on in the second roller to maintain the proper temperature of the surface of that roller, and to maintain the adhesive at the preset temperature with an associated viscosity of the adhesive satisfactory for proper transfer to the stack of pages. Further the embodiment is such that the unit can be easily removed by disconnecting electrical connectors and lifting the unit out of holes made in the base plate to match the location of the adjusting screws and can quickly be replaced with a unit containing a different type of adhesive to match the needs of a different types of binding, i.e. padded materials vs. perfect bound with cover materials.

Although the purpose in designing this type of adhesive applicator was to provide a fast warmup, interchangeable, inexpensive, versatile, adhesive applicator that could be used in either an off-line or in-line bookbinding system it is apparent that the present invention could be used for any application requiring the application of hot melt adhesives or other liquids, either requiring heating or not.

The invention also solved a nagging problem with previous designs in that by moving the clamped document perpendicular to the direction of rotation of the rollers instead of the conventional method of moving the stack in a direction parallel to the pages, no adhesive will be attached to the ends of the finished pad or book. Buildup of the adhesive on the leading and trailing edges which now become the sides of the bind are not as critical, however it was found that by matching the linear speed of the stack with the linear speed of adhesive the build up was minimized to an acceptable level without providing complex devices to raise or lower the applicator or reverse roller directions or spray the adhesive or other proposed methods.

All of this was achieved while designing the device to be used on standard 15 ampere, 120 volt, 60 hertz electricity available in all user locations in the United States.

PREFERRED EMBODIMENT—DESCRIPTION

Figure 1:
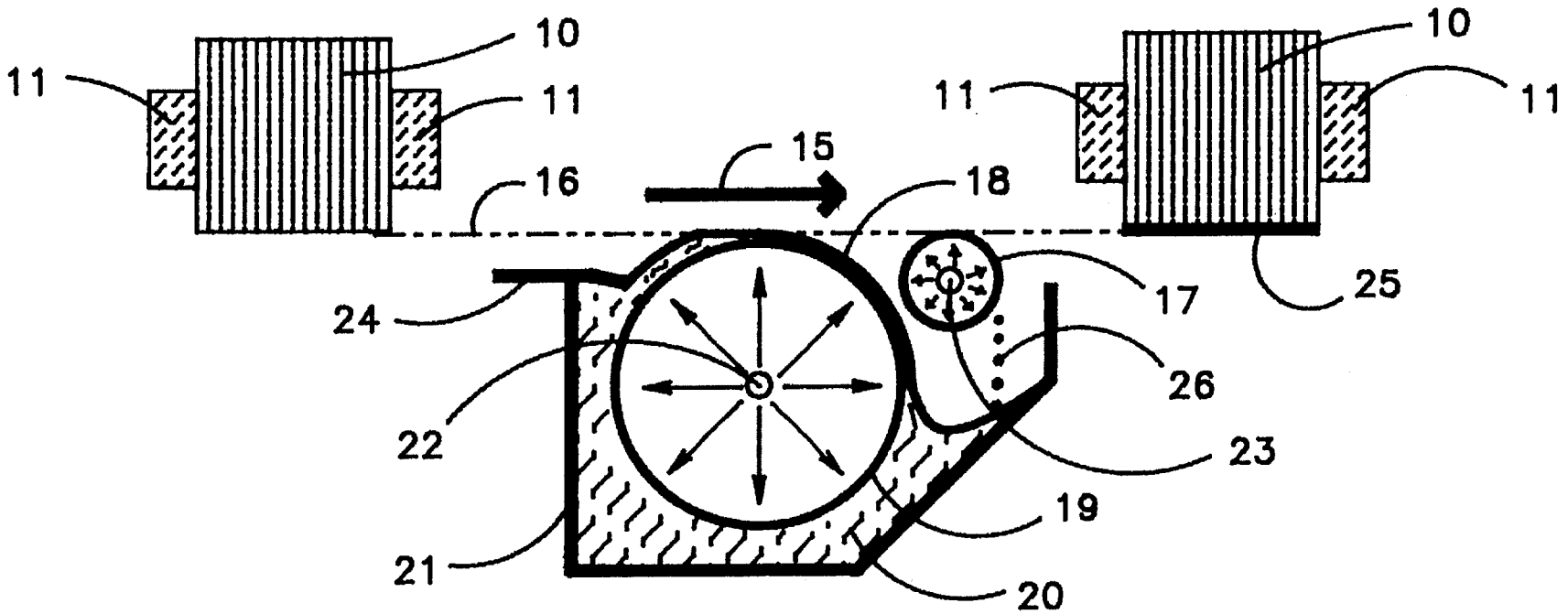
FIG. 1 is a simplified side view cross-section of my invention showing some of the key features.

As shown in Fig. 1 a stack 10 of sheets or signatures held between clamps 11 which can be either fixed or attached to rails for lateral relative motion along path 16 to the adhesive applicator in the direction represented by the arrow 15 across an adhesive applying roller 19 and an adhesive doctoring roller 17. The roller 19 is partially immersed in a vessel 21 from which adhesive is drawn to be deposited on the underside of the stack 10 to form a bind 25. The roller 19 is heated by a heater lamp 22 similar to those used in fuser rollers for office copiers. The radiated heat rapidly causes the surface of roller 19 to become heated which in turn causes the adhesive 20 closest to the roller 19 to achieve a melting temperature. The adhesive 20 is contained in the vessel 21 and is of the standard hot-melt adhesives that melt in the range between 250 and 360 degrees Fahrenheit operating temperatures. The lamp 22 works best in the range of 1,000 watts rated power. This causes the adhesive to melt within 3 minutes sufficiently to allow the roller 19 to rotate after which the adhesive 20 is leveled by doctor blade 24. The adhesive 20 is then ready for application to the stack 10 and it follows the path 18 in returning to the vessel 21. Once the roller 19 achieves the temperature necessary to melt the adhesive 20 the lamp 22 is turned off and lamp 23 is turned on and radiates heat to the roller 17 which brings the surface temperature of roller 17 to over 200 degrees Fahrenheit. Lamp 23 is similar to those used in office copiers and works best in the range of 400 watts rated power. When the temperature of the adhesive 20 on roller 19 drops below a set point, lamp 23 turns off and lamp 22 turns on to maintain the desired melting temperature which is associated with the desired viscosity of the adhesive 20. The heater lamp 23 is also controlled by a proportioning timer to prevent overheating of roller 17. The relative height of the stack 10 over roller 17 allows the adhesive 25 to be doctored to the desired thickness and smoothness. Excess adhesive 26 drops into the vessel 21 to be added to the adhesive 20.

Figure 2:
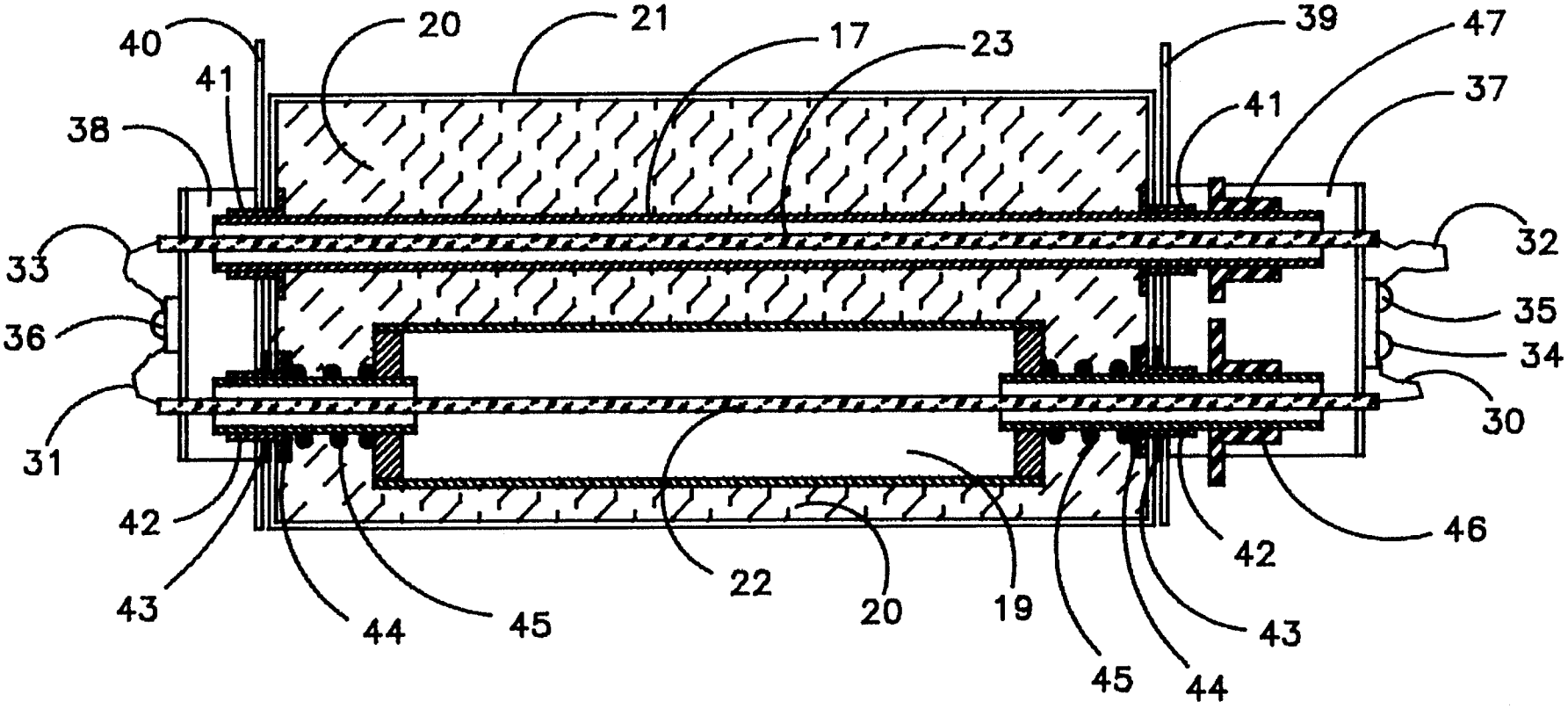
FIG. 2 is a top view of a cross-section of my invention showing the basic elements.

As shown in FIG. 2 the vessel 21 is supported by sideplate 39 and sideplate 40. Bearings 41 which are standard sintered bronze bearings support the roller 17 while bearings 42 support the roller 19. The lamp 23 is supported on the ends by bracket 37 and bracket 38 while the lamp 22 is also supported by bracket 37 and bracket 38 so that the lamps are centered in the rollers. The sprocket 47 is attached to roller 17 while sprocket 46 is attached to roller 19. The adhesive 20 is prevented from leaking from container 21 by seal 43 trapped between sideplate 39 and the container 21 on the outside diameter of bearing 42. The adhesive 20 is also prevented from leaking from container 21 by seal 44 which is located on the outside diameter of the roller shaft for roller 19 and is pushed against the bearing 42 by compression spring 45.

Power is provide to the lamp 23 via high temperature insulated wire 32 and high temperature insulated wire 33 through contact 34 and contact 36. Power to lamp 22 is provided though high temperature insulated wire 30 and high temperature insulated wire 31 through contact 34 and contact 36.

Figure 3:
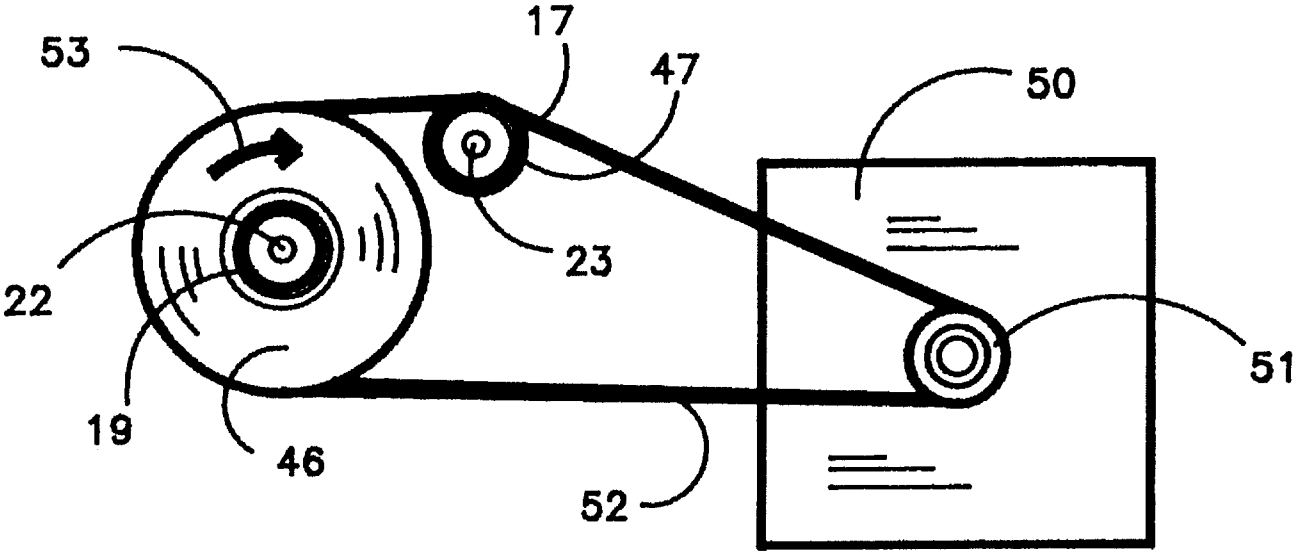
FIG. 3 is a side view of my invention showing the drive train and motor.

The drive system shown in FIG. 3 consists of a constant speed unidirectional motor 50 with a sprocket 51 attached to the motor shaft. A sprocket 46 is attached to the end of the shaft of roller 19 and is of such diameter as to maintain the same constant linear speed of motion of the adhesive 18 at the plane 16 as that of the motion of the stack 10. Sprocket 47 is attached to the end of roller 17 and is of such diameter as to maintain a constant linear velocity of the surface of the roller 17 at the plane 16 slightly faster than that of the linear velocity of stack 10. The sprocket 46 and the sprocket 47 are driven by chain 52 from sprocket 51 in the direction of rotation 53 of the sprocket 46. Thus roller 19 and roller 17 rotate in the same direction with the velocity of the surface of the roller 17 being slightly faster than that of the adhesive 18 on roller 19 in plane 16.

Figure 4:
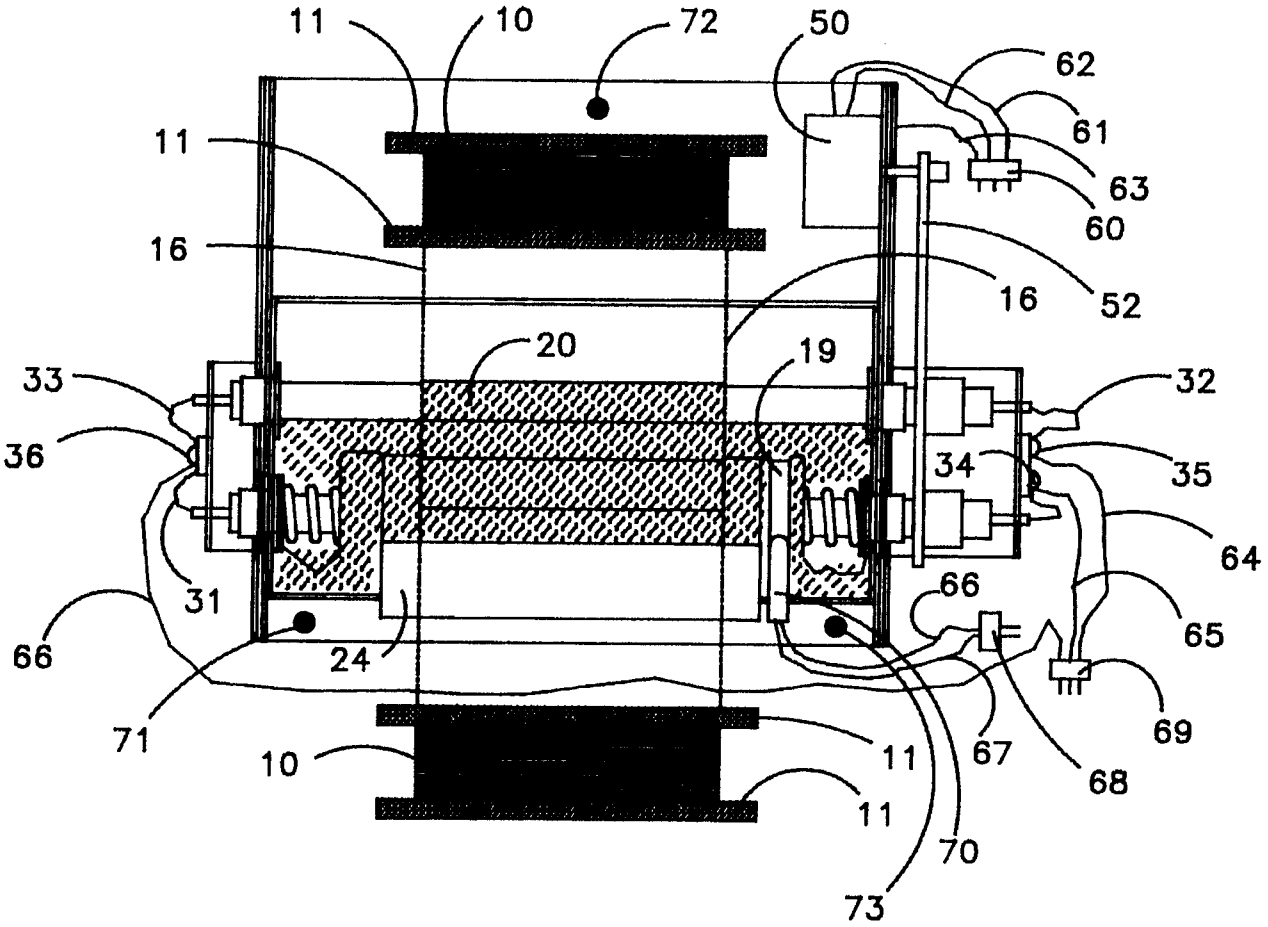
FIG. 4 is a top external view of my invention showing the basic operation of the apparatus with the path of travel of the stack of clamped pages.
Figure 5:
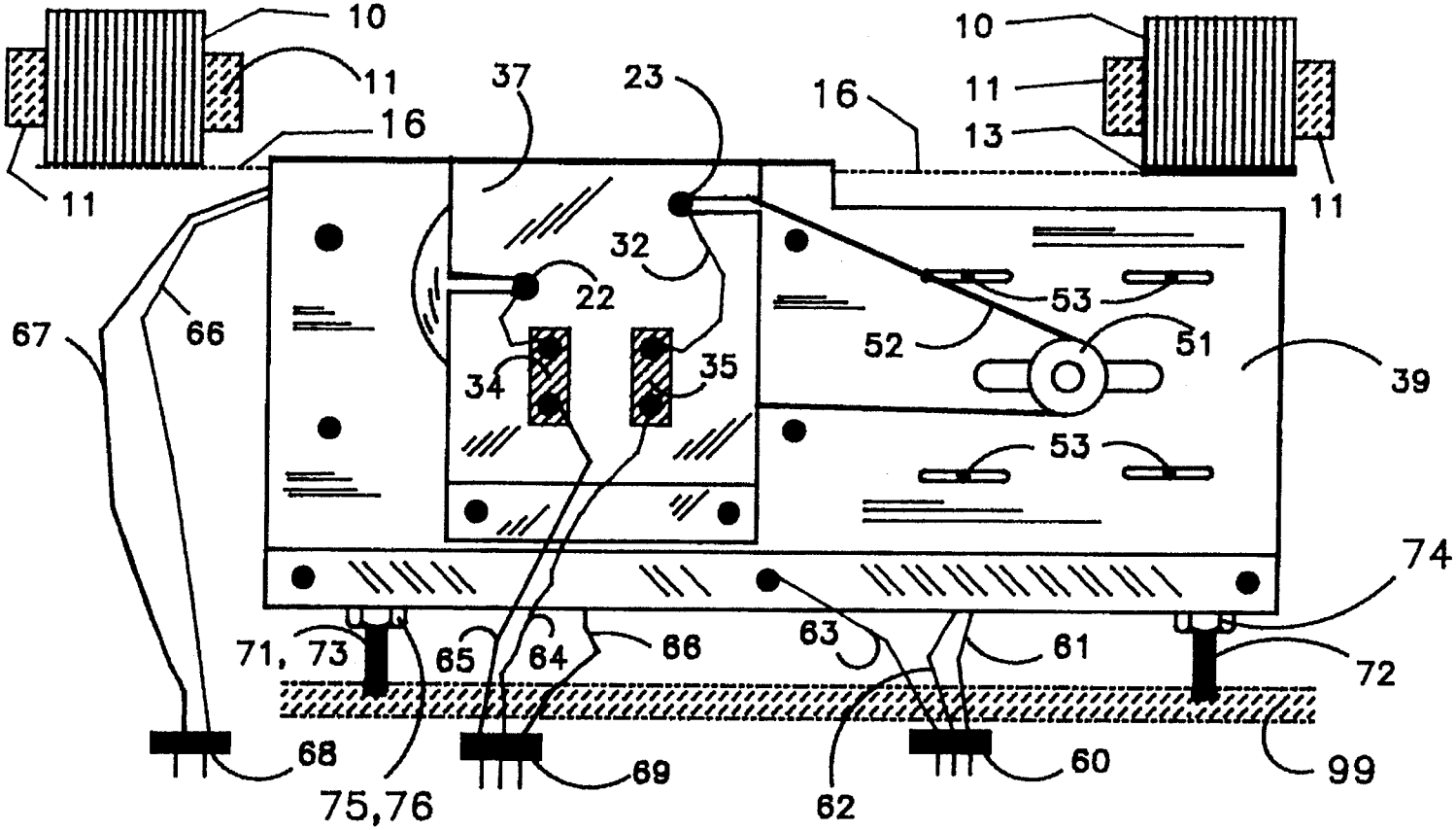
FIG. 5 is an external side view of the drive side showing electrical connections and leveling screws with motor and chain adjustment and the path of travel of the clamped stack of pages.
Figure 6:
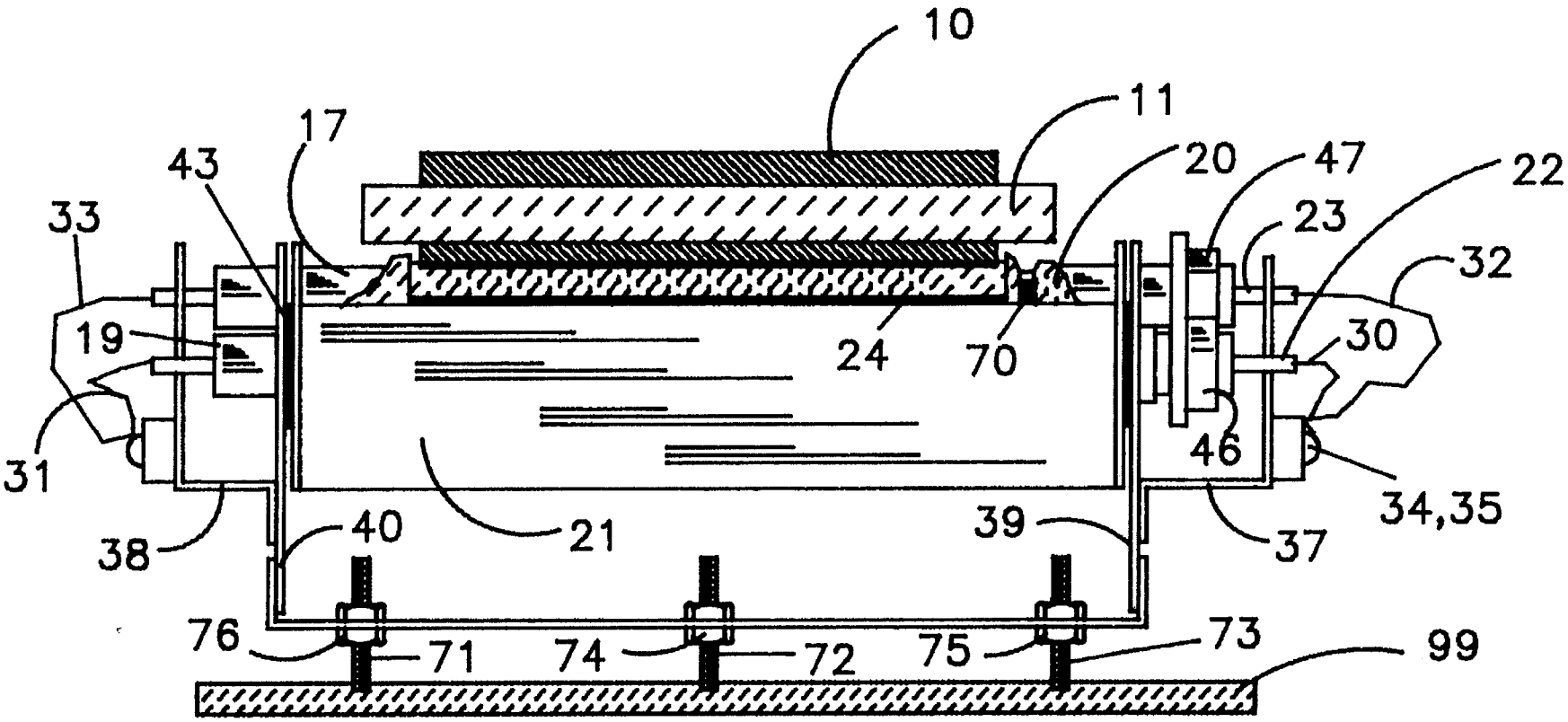
FIG. 6 is a frontal view from the input end with the applicatior roller showing the plane of travel of the clamped pages and leveling screws.

FIG. 4 and FIG. 5 and FIG. 6 show the relative motion of the stack 10 through the adhesive 18 as it is picked up from the roller 19 after it is leveled by doctor blade 24. The motor 50 is powered through insulated wire 61 and insulated wire 62. The entire unit is grounded through wire 63 for safety. For interchangeability of the unit, wire 61, wire 62 and wire 63 are fed through connector 60.

The temperature on the surface of roller 19 is sensed by thermocouple 70 which is in direct contact with roller 19. Current through the thermocouple 70 is fed through wire 66 and wire 67. Wire 66 and wire 67 are fed through connector 68 for interchangeability of the unit.

Power to the contact 34 is provided through wire 65 from connector 69 and through contact 36 through wire 66 from connector 69. Power to contact 35 is provided through wire 64 through connector 69. Removal of power to the unit is done by disconnecting connector 69, connector 60 and connector 68.

Leveling and height adjustment of the unit to match the plane of the roller 19 and roller 17 with that of plane 16 is accomplished by adjustment of the leveling screw 71, leveling screw 72, and leveling screw 73. Height adjustment is accomplished by simultaneous adjustment while pitch and roll are accomplished by differential adjustment. Once the adjustment is complete lock nut 74, lock nut 75, locknut 76 are tightened to secure the adjustment. The entire assembly is set into holes in the base plate 99. The base plate 99 can be stationary if the clamps 11 are attached to rails or can be attached to rails if the clamps 11 are stationary to provide the relative motion between the clamps 11 and the adhesive 18 in the plane 16.

Figure 7:
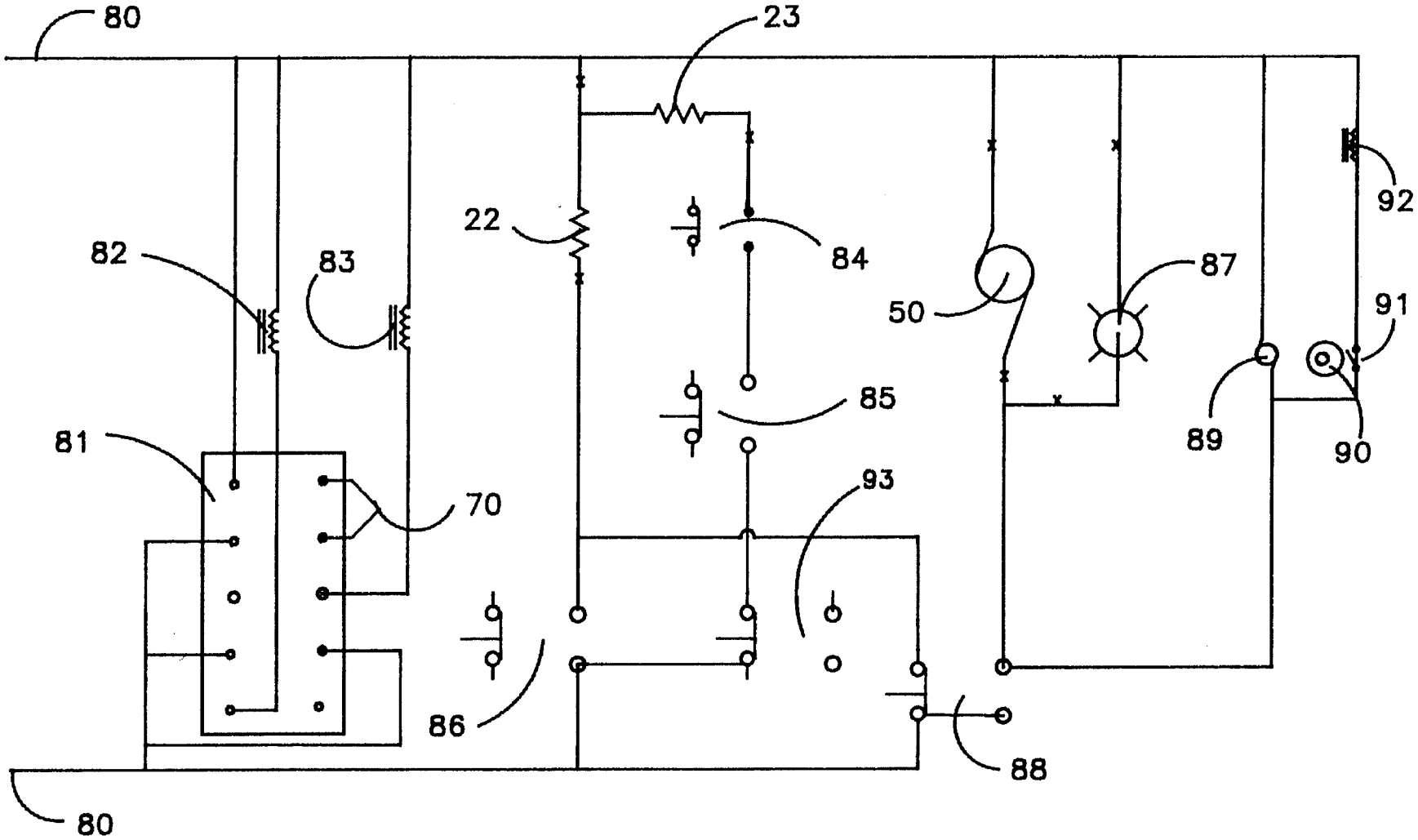
FIG. 7 is an electrical schematic of the control circuit of the apparatus.

Control of the apparatus is achieved as shown in the circuit diagram in FIG. 7. A microprocessor such as is available in a controller 81 manufactured by Omega, Omron, and others is shown. Alternating current power (typically U.S. Power 120 V AC 60 Hz) is provided through wires 80. The thermocouple 70 provides a direct current signal to the controller and the controller 81 compares this signal to a programmed temperature level. When power is first provided to the apparatus the heater relay 82 is turned on which closes the heater relay contacts 86 which causes the heater lamp 22 to be turned on, heating the roller 19. At the same time heater relay contacts 93 are opened to prevent the heater lamp 23 from being turned on. Once the preset temperature is achieved the heater relay 82 is turned off and the ready relay 83 is turned on. The heater relay contacts 86 are opened preventing current flowing to heater lamp 22. Heater relay contacts 93 are closed to allow current to flow to heater lamp 23. Cycling of heater lamp 23 is controlled through timer relay contacts 84 and ready relay contacts 85. When ready relay contacts 85 are closed the motor 50 is turned on which causes rollers 17 and 19 to rotate. Ready light 87 is also turned on to show the operator that the apparatus is ready to be used. In the same circuit timer motor 89 is turned on causing cam 90 to rotate and cycle switch 91 which causes the timer relay to cycle which causes heater lamp 23 to be cycled to control the heat radiated to roller 17 in a predetermined fashion.

PREFERRED EMBODIMENT—OPERATION

The sequence of operation is when power is supplied at wires 80, the controller 81 becomes operational. Heater lamp 22 is turned on until the proper adhesive melting temperature is reached on the surface of the adhesive applicator roller 19 sensed by thermocouple sensor 70. When this occurs the heater lamp 22 is turned off and the unidirectional motor 50 runs causing the rollers 19 and 17 to rotate. At the same time heater lamp 23 is turned on to heat the doctor roller 17. The system is now ready to make pads or books, or apply other liquids to other entities.

The stack of clamped pages 10 is moved relative to the adhesive applicator roller 19 at the same velocity as the adhesive on the applicator roller 19 and relative to the doctor roller 17 through plane 16 and will have a coating of adhesive 25 applied to the bottom of the stack of clamped pages based on the height of the adhesive on the applicator roller 19, the height adjustment of the apparatus and the spacing between the doctor roller 17 and the bottom of the stack of clamped pages 10.

What is claimed is:

1. An apparatus for applying a layer of adhesive to a stack of clamped pages comprising:

a vessel containing a reservoir of adhesive;

an applicator roller rotatable in said adhesive and positioned to move said adhesive to the stack of clamped pages;

a doctor roller positioned downstream of said applicator roller to intersect with a spine of said pages to smooth the adhesive applied by the applicator roller;

means disposed in said applicator roller to melt the adhesive;

means disposed in said doctor roller to heat said doctor roller;

means in communication with said vessel to interchange said vessel with another vessel in an easily removable manner;

means to level adhesive on the applicator roller by use of a doctor blade disposed next to and parallel with the roller;

means in communication with said applicator and doctor rollers to drive the rollers at predetermined speeds to achieve adhesion and appearance of a finished bind;

means to adjust the applicator and doctor rollers with the path of travel of the stack of pages by use of leveling screws located at a base of the vessel so that the rollers with not come out of adjustment once set;

means connected to said applicator and doctor rollers to electrically control the temperature of respective roller surfaces; and means to turn on the apparatus and indicate to an operator that the apparatus is ready for use.

* * * * *